US011202933B2

(12) United States Patent
Desrosiers

(10) Patent No.: US 11,202,933 B2
(45) Date of Patent: Dec. 21, 2021

(54) RESISTANCE TRAINING HARNESS

(71) Applicant: Michelle Desrosiers, Kingston (CA)

(72) Inventor: Michelle Desrosiers, Kingston (CA)

( * ) Notice: Subject to any disclaimer, the term of this patent is extended or adjusted under 35 U.S.C. 154(b) by 0 days.

(21) Appl. No.: 16/634,618

(22) PCT Filed: Aug. 18, 2017

(86) PCT No.: PCT/CA2017/000193
§ 371 (c)(1),
(2) Date: Jan. 28, 2020

(87) PCT Pub. No.: WO2019/033194
PCT Pub. Date: Feb. 21, 2019

(65) Prior Publication Data

US 2020/0269082 A1 Aug. 27, 2020

(51) Int. Cl.
*A63B 21/00* (2006.01)
*A63B 21/055* (2006.01)
(Continued)

(52) U.S. Cl.
CPC ..... *A63B 21/4025* (2015.10); *A63B 21/0552* (2013.01); *A63B 21/154* (2013.01);
(Continued)

(58) Field of Classification Search
CPC ..... A63B 21/40–4001; A63B 21/4005; A63B 21/4007; A63B 21/4009; A63B 21/4011; A63B 21/4025; A63B 21/0552; A63B 21/154; A63B 23/02; A63B 23/04; A63B 69/002; A63B 69/0028; A63B 69/0035;
(Continued)

(56) References Cited

U.S. PATENT DOCUMENTS 1,050,257 A * 1/1913 Trigg ..... A61F 5/026 2/45
5,080,191 A 1/1992 Sanchez
(Continued)

FOREIGN PATENT DOCUMENTS

WO 2014131446 A1 9/2014

OTHER PUBLICATIONS

International Search Report dated Apr. 24, 2018 from corresponding PCT Patent Application No. PCT/CA2017/000193.

*Primary Examiner* — Megan Anderson
*Assistant Examiner* — Kathleen Vermillera
(74) *Attorney, Agent, or Firm* — Grogan, Tuccillo & Vanderleeden, LLP

(57) ABSTRACT

In at least one embodiment a resistance training harness is provided having a first upper loop having a front portion and a rear portion, a second upper loop having a front portion and a rear portion, at least one front connector, the first end of the at least one front connector adjoining at least one first upper loop and the second upper loop; a transverse belt component adjoining the second end of the at least one front connector, the first end of the transverse belt component and second end of the transverse belt component having attachment means, a first lower loop having a front portion and a rear portion, a second lower loop having a front portion and a rear portion, and at least one resilient cord adapted to engage with the resistance training harness.

11 Claims, 7 Drawing Sheets

(51) Int. Cl.
*A63B 23/02* (2006.01)
*A63B 23/04* (2006.01)

(52) U.S. Cl.
CPC ..... *A63B 21/4007* (2015.10); *A63B 21/4009* (2015.10); *A63B 23/02* (2013.01); *A63B 23/04* (2013.01)

(58) Field of Classification Search
CPC ..... A63B 69/0057–0062; A62B 35/00; A62B 35/0006; A62B 35/0018; B64D 17/30
See application file for complete search history.

(56) References Cited

U.S. PATENT DOCUMENTS 5,613,926 A * 3/1997 Michaelson ..... A63B 21/0552 482/121
6,125,966 A 10/2000 Jones
7,608,026 B1 * 10/2009 Nicassio ..... A63B 21/00185 24/265 BC
7,707,652 B2 5/2010 Senegal
7,874,970 B2 1/2011 Glisan
7,914,473 B2 * 3/2011 Josey ..... A63B 23/0244 602/19
10,166,426 B2 * 1/2019 Adeeko, Jr. ..... A63B 21/0557
2005/0282689 A1 * 12/2005 Weinstein ..... A63B 21/4009 482/124
2007/0015640 A1 * 1/2007 Demeniuk ..... A63B 21/4035 482/124
2008/0076645 A1 * 3/2008 Brown ..... A63B 21/4007 482/124
2009/0011909 A1 * 1/2009 Glisan ..... A63B 21/4007 482/129
2013/0143723 A1 * 6/2013 Bender ..... A63B 21/02 482/121

* cited by examiner

RESISTANCE TRAINING HARNESS

This application is a National Stage of International Patent Application No. PCT/CA2017/000193 filed on Aug. 18, 2017, which is incorporated herein in its entirety.

FIELD

The present invention relates to athletic training equipment. More specifically, the present invention relates to a harness for providing resistance during athletic training.

BACKGROUND

Resistance training is a popular form of fitness and athletic training that can take a variety of forms. For example, in weight training the resistance is provided by gravity. Purpose-built exercise machines may employ rubber bands, fans, spring coils, or friction generating elements in order to increase the resistance that a user experiences when training a particular muscle group or athletic movement.

The aim of resistance training (which includes strength training and weight training) is to force the user to repeatedly contract targeted muscles under resistance which can build strength, anaerobic endurance and muscle size. A number of benefits can be realized through strength training which can include, but is not limited to, increased bone, muscle, tendon, and ligament strength and toughness, improved joint function, reduced potential for injury, increased bone density, increased metabolism, increased fitness and improved cardiac function.

As sports science becomes a more mature discipline, specialized training exercises and equipment have been developed that focus on particular movements that are unique to particular sports. Even within a single sport, different athletes may have different training needs and as such must perform specialized exercises in order to optimize the results of their training.

One type of sport-specific training can involve harnesses or "shapewear" that encourages proper posture and form during the entirety of the exercise. For example, weight lifters commonly where support belts to provide lumbar and abdominal support during weight lifting exercises.

However, there are no known harness that employ an aspect of resistance training as an integral aspect of the harness, so that a resistance training exercise can be performed with proper posture and form, all while reaping the many benefits of resistance training that have been identified herein.

Accordingly, there is a need for a specialized resistance training harness that permits an athlete to perform a number of sport-specific resistance training exercises with proper form and posture.

SUMMARY

The present invention provides a specialized resistance training harness that permits an athlete to perform a number of sport-specific resistance training exercises with proper form and posture.

In at least one embodiment, the resistance training harness has a first upper loop having a front portion and a rear portion, the rear portion having an outer surface having attachment means; a second upper loop having a front portion and a rear portion, the rear portion having an outer surface having attachment means, the front portion of the first loop adjoining the front portion of) the second loop, at least one front connector, each at least one front connector having a first and a second end, the first end of the at least one front connector adjoining at least one of the front loop portion of the first upper loop and the front loop portion of the second upper loop, a transverse belt component having a first end and a second end, the transverse belt component adjoining the second end of the at least one front connector between the first end and the second end of the transverse belt component, the first end of the transverse belt component and second end of the transverse belt component having attachment means, a first lower loop having a front portion and a rear portion, a second lower loop having a front portion and a rear portion, the first lower loop and the second lower loop adjoining the transverse belt component; and at least one resilient cord, said resilient cord having at least one connector adapted to engage with the) attachment means of at least one of the first upper loop portion, the second upper loop portion, the first lower loop portion and the second lower loop portion.

BRIEF DESCRIPTION OF THE FIGURES

The present invention will be better understood in connection with the following Figures, in which.

DETAILED DESCRIPTION OF THE EMBODIMENTS

Figure 1:
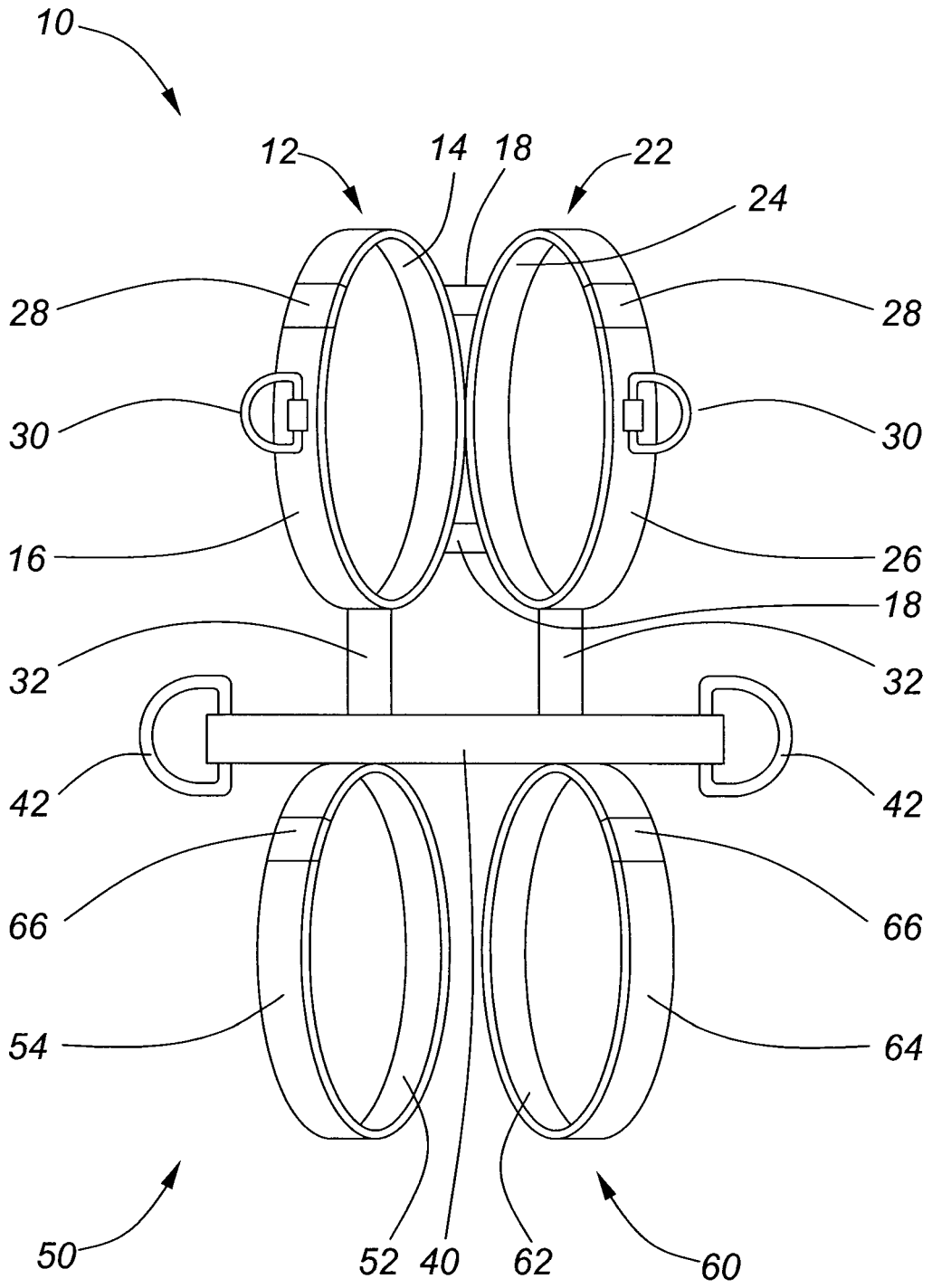
FIG. 1 is a rear view of a resistance training harness in accordance with at least one embodiment of the present invention.

In at least one embodiment, it is contemplated that the present invention can provide a specialized resistance training harness that permits an athlete to perform a number of sport-specific resistance training exercises with proper form and posture.

As will be readily understood by the skilled person, it is contemplated that the present invention can be manufactured out of any number of suitable materials depending on the needs of the particular end user application, including but not limited to: ballistic nylon fabrics, strapping and webbing, Cordura®, Kevlar®, neoprene, various leathers, rubber, and other suitable woven and non-woven strapping and webbing materials.

Similarly, it will be readily appreciated that the present invention can be produced by any known, suitable manufacturing techniques and methods, including but not limited to: weaving, stitching, adhesive and chemical bonding and riveting, among any other suitable known techniques. In some embodiments, it is contemplated that the present invention can be constituted of a single, unitary component, while in other embodiments it may be constituted of separate components suitably joined together. Moreover, the present invention can be manufactured to any suitable dimensions as required by the specific end user application.

It is contemplated that the various components disclosed herein can be padded or not padded depending on the needs of the particular end user application. Moreover, it is contemplated that these components can be manufactured in any suitable dimensions and finished with any suitable materials in order to create the most comfortable yet secure fit possible for the user.

In at least one embodiment, the present invention provides a resistance training harness having a first upper loop adjoined to a second upper loop. Both upper loops have a front upper loop portion and a rear upper loop portion. In some embodiments is contemplated that the each rear upper loop portion has an adjustable connector and attachment means.

It is contemplated that the adjustable connector can take a nearly limitless number of forms provided that it permits the upper loop portions to be opened and closed (or, alternatively, loosened and tightened) so that a user can don and then in turn remove the resistance training) harness. Suitable connectors include, but are not limited to, a hook and loop strap fastener, a ratchet strap, a snap-fit buckle, a clasp closure, a double D ring closure and a triple D ring closure, among other strap connector arrangements that will be readily apparent to the skilled person. In these embodiments, it is contemplated that the adjustable connector is positioned such that the user can access the adjustable connectors on the upper lower loop portion when wearing the resistance training harness In other embodiments it is contemplated that the upper loop portions are sufficiently elasticized to allow the user to slip the resistance training harness on and off without needing an adjustable connector present.

It is also contemplated that the attachment means can take a variety of forms. In at least one embodiment, it is contemplated that the attachment means are a single metal ring (such as a D ring or a circular ring) that is secured to the outer surface of the rear upper loop portions in a pivotable fashion, although other arrangements are certainly contemplated.

In some embodiments, it is contemplated that the front upper loop portions can be non-elasticized while the rear portion upper loop portions can be elasticized to improve the fit and the donning and removal of the resistance training harness, however other arrangements are also contemplated.

In some embodiments, it is contemplated that the first upper loop and the second upper loop can be formed out of two overlapping elongate strap elements each having a first end and a second end in a roughly lemniscate (i.e. "FIG. 8") shape that defines the first upper loop and the second upper loop as will be discussed in further detail below.

In these embodiments, the first end of a first elongate strap element can be joined with the second end of a second elongate strap element by way of an adjustable connector and the first end of the second elongate strap element can be joined with the second end of the first elongate strap element by way of an adjustable connector. In this way, the first elongate strap element will cross the second elongate strap element adjacent the user's sternum, resulting in a secure fit and robust design that is durable when placed under significant tension by the user. It is contemplated that the first elongate strap element can be secured to the second elongate strap element at the overlapping point or these two strap element can also simply abut one another in an unsecured way.

In some embodiments, it is contemplated that one or multiple transverse front braces can extend transversely and horizontally from an outer surface of the first upper front loop portion to an outer surface of the second upper front loop portion in order to give further stability to the resistance training harness.

Similarly, it is also contemplated that the present invention can include one or multiple transverse back braces that can extend transversely and horizontally from an outer surface of the first upper rear loop portion to an outer surface of the second upper rear loop portion in order to give further stability to the resistance training harness.)

In some embodiments, it is contemplated that the resistance training harness can have at least one front connector that extends downwardly from one of the front loop portions to a transverse belt component. It is contemplated that the front connector can be an individual adjustable strap, an individual non-adjustable strap, multiple straps or a wider component, depending on the needs of the particular end-user application.

Moreover, it is contemplated that the front connector can be secured to the front loop portions and the transverse belt component or it can be removeably attached to the front loop portions and the transverse belt component.

In this way, it is contemplated that the resistance training harness can be used separately as an upper body resistance training harness and a lower body resistance training harness or connected together as a full body resistance training harness, depending on the needs of the particular end-user application.

In some embodiments it is contemplated that the front connector is a strap that is composed of two components that are joined by a suitable fastener, such as a hook-and-loop fastener. In these embodiments it is contemplated that the ends of front connector can be fixed to the front loop portions and the transverse belt component.

The transverse belt component has a first end and a second end. It is contemplated that each end can further have attachment means that can take a variety of forms including, but not limited to, a metal ring that is secured to the ends of the transverse belt component, although other arrangements are certainly contemplated.

It is further contemplated that the transverse belt component can be adjoined to a first lower loop and a second lower loop. The lower loops can be located near the ends of the transverse belt component or at a more central location between the first end and the second end of the transverse belt component. Both lower loops have a front lower loop portion and a rear lower loop portion. In some embodiments is contemplated that the each rear lower loop portion has an adjustable connector. In these embodiments, it is contemplated that the adjustable connector is positioned such that the user can access the adjustable connectors on the rear lower loop portion) when wearing the resistance training harness.

It is contemplated that the adjustable connector can take a nearly limitless number of forms provided that it permits the rear loop portions to be opened and closed (or, alternatively, loosened and tightened) so that a user can don and then in turn remove the resistance training harness. Suitable connectors include, but are not limited to, a hook and loop strap fastener, a ratchet strap, a snap-fit buckle, a clasp closure, a double D ring closure and a triple D ring closure among other strap connector arrangements that will be readily apparent to the skilled person.

It is contemplated that the first lower loop and the second lower loop can be constructed of a single component or multiple components joined together. Moreover, it contemplated that the first lower loop and the second lower loop can be oriented substantially perpendicularly relative to the transverse belt component or alternatively the first lower loop and the second lower loop can be oriented along axes that are inwardly or outwardly oriented relative to the transverse belt component, depending on the needs of the particular end user application of the present invention.

In other embodiments it is contemplated that the lower loop portions are sufficiently elasticized to allow the user to slip the resistance training harness on and off without needing an adjustable connector present.

In other embodiments it is contemplated that the lower loop portions are "teardrop" shaped (i.e.: lachrymiform) in order to better accommodate the circumference of the wearers legs such that the vertex of the teardrop shape abuts the transverse belt component. In these embodiments it is contemplated that the loops can be oriented along a vertical axis or along an axis that is angled relative to perfect verticality, as require by the specific end-user application.

In some embodiments, it is contemplated that the front lower loop portions can be non-elasticized while the rear lower loop portions can be elasticized to improve the fit and the donning and removal of the resistance training harness, however other arrangements are also contemplated.)

It is contemplated that the present resistance training harness includes at least one resilient cord that has at least one end that is adapted to connect to the attachment means of the resistance training harness as discussed herein, In some embodiments it is contemplated that the resilient cord is elasticized while in other embodiments it is contemplated that the resilient cord is not particularly elasticized whatsoever.

In some embodiments, a first end of the resilient cord is removeably attached to the attachment means provided on the resistance training harness while the second end is fixed to a structure (such as a wall, a parachute, a ceiling or a pole).

In other embodiments, the first end of the resilient cord is removeably attached to an attachment means provided on the resistance training harness while the second end of the resilient cord is removeably attached to another set of attachment means provided on the resistance training harness and the resilient cord is looped around a pole or an anchor. In these embodiments, it is contemplated that the ends of the resilient cord include a carabiner or similar type of shackle, although other arrangements are also contemplated as will be appreciated by the skilled person.

It is contemplated that the structure can have a number of additional features that increase the functionality of the present invention. For example, the structure can include at least one pulley or analogous device which can in turn receive each resilient cord, thereby permitting smooth) movement of the resilient cord as the user moves relative to the structure. Moreover, it is contemplated that this pulley could in turn be mounted to a sliding track or analogous device which in turn permits the pulley to move along the sliding track as the user moves relative to the structure. To this point, it is contemplated that the sliding track can be oriented vertically, horizontally, or in any other direction that is required by the particular end user application.

In this way the user can don the resistance training harness by inserting the arms through the upper loops of the harness and the legs through the lower loops of the harness such that the transverse belt component extends across the user's hips (ideally, below the user's waist) and the upper loops are adjoined across the user's chest. The upper and lower loops can be secured about the user's arms and legs using the provided adjustable connectors, where provided, in order to) obtain a secure fit.

Next, one end of a first, elasticized resilient cord can be attached to one of the upper attachment means, the first resilient cord can be looped around a post, and the second end of the first resilient cord can be attached to the other of the upper attachment means. Similarly, one end of a second, elasticized resilient cord can be attached to the one of the lower attachment means, the second resilient cord can be looped around the same post, and the second end of the second resilient cord can be attached to the other of the lower attachment means.

In this way the user is now harnessed to the post, and can perform a number of exercises in which the user's movements may be limited and therefore the intensity of performing that movement is increased. As such, a number of hyper-specific exercises may be developed that are intended to train certain muscle groups or certain movements.

Given the shape of the present resistance training harness, the user is encouraged to adopt an idealized "athletic" stance when wearing the resistance training harness as the knees must be slightly bent, the user's weight must be balanced over the front parts of the feet, the abdominal muscles engaged and shoulders held back as the resilient cords are held taut between the user and the pole.

Moreover, given that in some embodiments there is no transverse rear connector between the rear upper loop portions (i.e. across the user's back), the user in encouraged to adopt and maintain a posture where the shoulders are held outwardly and backward and the chest is thrust upward and forward, the user naturally can engage in the desired idealized "athletic" stance when wearing the resistance training harness.

In this way, it is contemplated that the user adopts excellent posture when engaging in any hyper-specific exercises while wearing the resistance training harness, resulting in overall improved training sessions.

Figure 2:
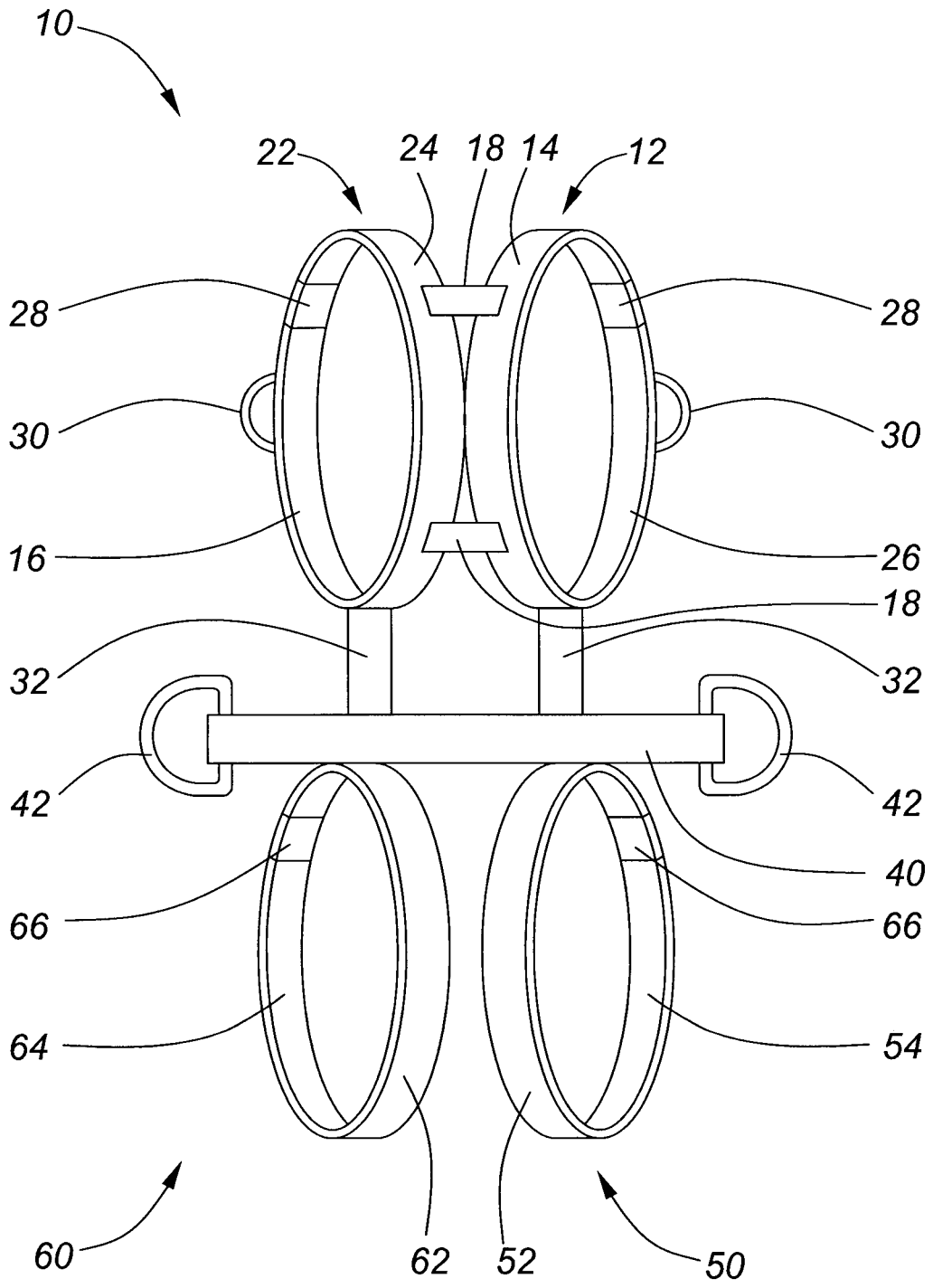
FIG. 2 is a front view of a resistance training harness in accordance with at least one embodiment of the present invention.

Turning to FIGS. 1 and 2, at least one embodiment of a resistance training harness in accordance with the present invention is illustrated. In this embodiment, resistance training harness 10 has a first upper loop 12 having a front upper loop portion 14 and a rear upper loop portion 16 and a second upper loop 22 having a front upper loop portion 24 and a rear upper loop) portion 26.

In this embodiment, front upper loop portion 14 adjoins front upper loop portion 24 at a position that is adjacent the user's sternum, as will be discussed in further detail below. Moreover, transverse brace portions 18 are provided that horizontally extend between an outer surface of upper loop portion 14 and an outer surface of front upper loop portion 24 in order to provide stability to the construction of resistance training harness 10.

In this embodiment, rear upper loop portion 16 and rear upper loop portion 26 include adjustable connectors 28 and attachment means 30. As discussed, herein, adjustable connectors 28 can take a wide variety of forms provided that they provide the ability to adjust the size of first upper loop 12 and second upper loop 22.

In this embodiment, attachment means 30 are a metal ring that has been pivotably fixed to the outer surface of rear upper loop portion 16 and rear upper loop portion 26, although other arrangements are also contemplated as will be contemplated by the skilled person.

In this embodiment, resistance training harness 10 has two front connectors 32 that each extend downwardly from the outer surface of upper loop portion 14 and the outer surface of front upper loop portion 24 to transverse belt component 40. Transverse belt component 40 extends horizontally from a first end to a second end.

Attachment means 42 are located at each end of transverse belt component 40 and are analogous to attachment means 30 discussed above. In this embodiment, attachment means 42 are a metal ring that has been pivotably fixed to the ends of transverse belt component 40, although other arrangements are also contemplated.

In this embodiment, resistance training harness 10 has a first lower loop 50 having a front lower loop portion 52 and a rear lower loop portion 54 and a second lower loop 60 having a front lower loop portion 62 and a rear lower loop portion 64. In this embodiment, first lower loop 50 and second lower loop 60 are fixed to transverse belt component 40.

In this embodiment, rear lower loop portion 54 and rear lower loop portion 64 include adjustable connectors 66. As discussed herein, adjustable connectors 66 are analogous to adjustable) connectors 28 and can take a wide variety of forms provided that they provide the ability to adjust the size of first lower loop 50 and second lower loop 60.

Figure 3:
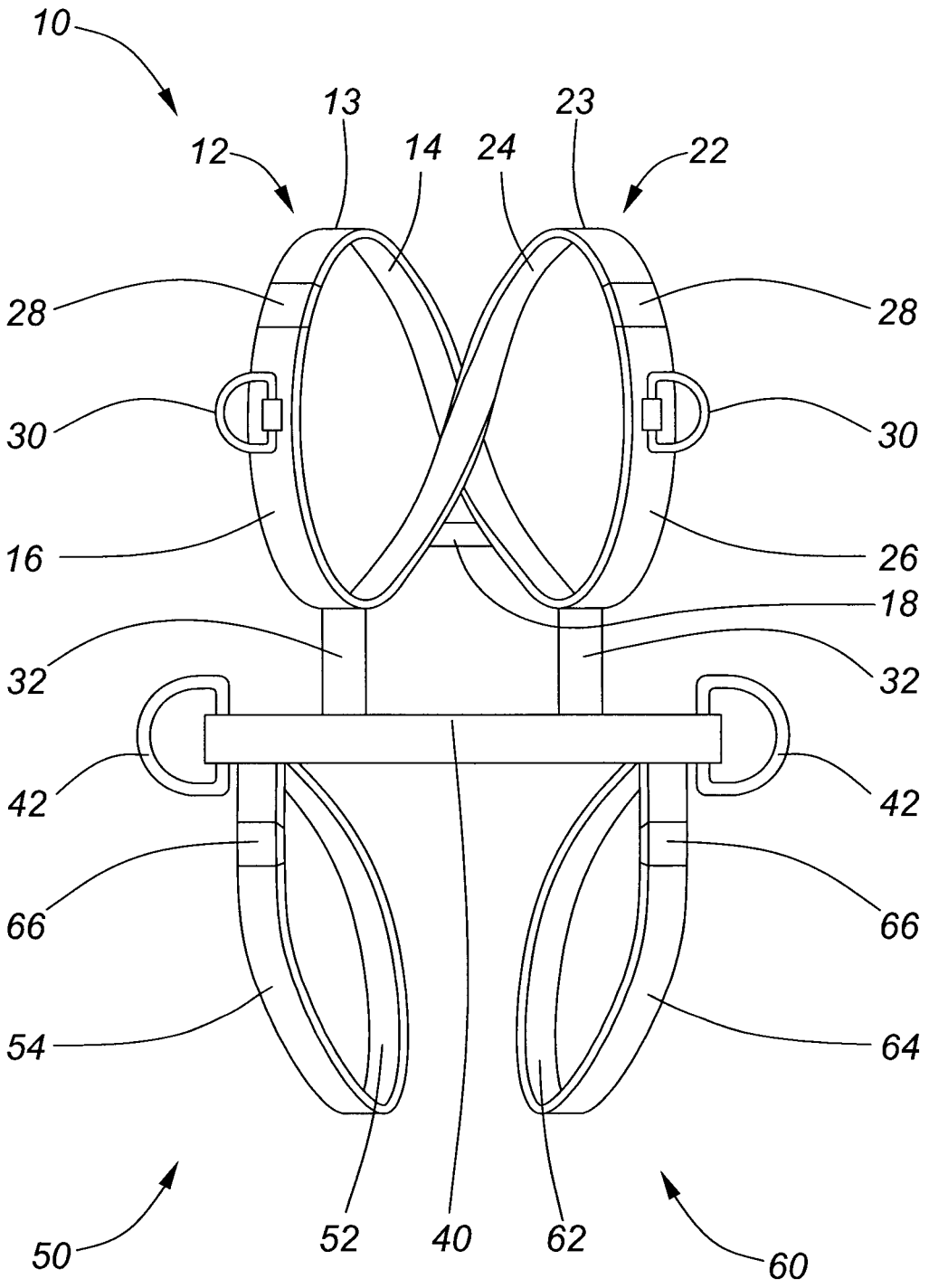
FIG. 3 is a rear view of a resistance training harness in accordance with another embodiment of the present invention.
Figure 4:
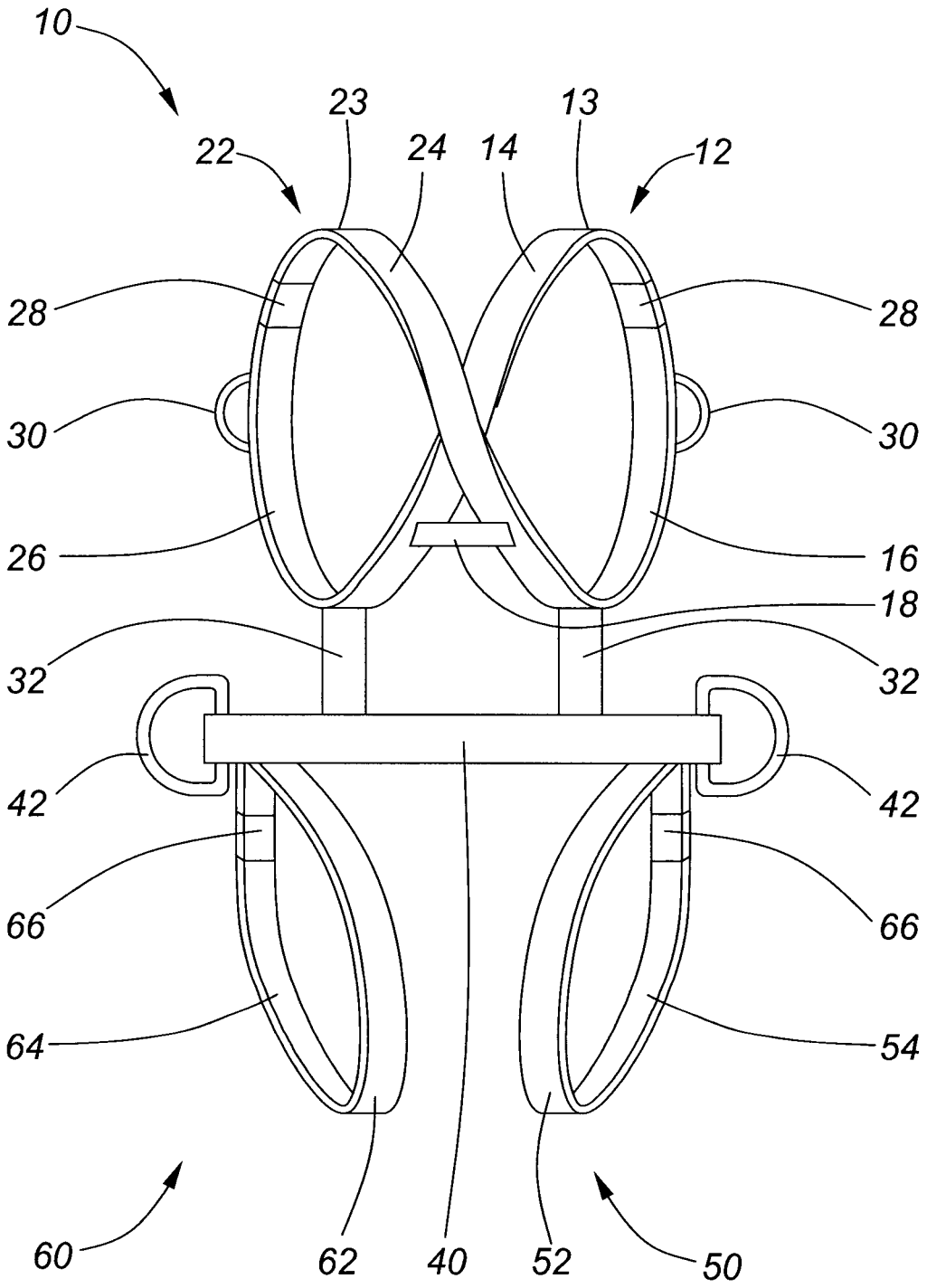
FIG. 4 is a front view of a resistance training harness in accordance with another embodiment of the present invention.

Turning to FIGS. 3 and 4, another embodiment of a resistance training harness in accordance with the present invention is illustrated. In this embodiment, resistance training harness 10 has a first upper loop 12 having a front upper loop portion 14 and a rear upper loop portion 16 and a second upper loop 22 having a front upper loop portion 24 and a rear upper loop portion 26.

In this embodiment, it is contemplated that first upper loop 12 and second upper loop 22 can be formed out of a first elongate strap element 13 and a second elongate strap element 23 each having a first end and a second end. First elongate strap element 13 and a second elongate strap element 23 overlap in a roughly lemniscate (i.e. "FIG. 8") shape that defines first upper loop 12 and second upper loop 22.

In this embodiment, the first end of first elongate strap element 13 is joined with the second end 22 of second elongate strap element 23 by way of an adjustable connector 28 and the first end of second elongate strap element 23 is joined with the second end of first elongate strap element 13 by way of adjustable connector 28.

In this embodiment, a transverse brace portion 18 is provided that horizontally extends between an outer surface of front upper loop portion 14 and an outer surface of front upper loop portion 24 in order to provide stability to the construction of resistance training harness 10.

In this embodiment, rear upper loop portion 16 and rear upper loop portion 26 include adjustable connectors 28 and attachment means 30. As discussed, herein, adjustable connectors 28 can take a wide variety of forms provided that they provide the ability to adjust the size of first upper loop 12 and second upper loop 22.

In this embodiment, attachment means 30 are a metal ring that has been pivotably fixed to the outer surface of rear upper loop portion 16 and rear upper loop portion 26, although other arrangements are also contemplated as will be contemplated by the skilled person.

In this embodiment, resistance training harness 10 has two front connectors 32 that each extend downwardly from the outer surface of upper loop portion 14 and the outer surface of front upper) loop portion 24 to transverse belt component 40. Transverse belt component 40 extends horizontally from a first end to a second end.

Attachment means 42 are located at each end of transverse belt component 40 and are analogous to attachment means 30 discussed above. In this embodiment, attachment means 42 are a metal ring that has been pivotably fixed to the ends of transverse belt component 40, although other arrangements are also contemplated.

In this embodiment, resistance training harness 10 has a first lower loop 50 having a front lower loop portion 52 and a rear lower loop portion 54 and a second lower loop 60 having a front lower loop portion 62 and a rear lower loop portion 64. In this embodiment, first lower loop 50 and second lower loop 60 are fixed to transverse belt component 40 in an inwardly oriented arrangement. Moreover, in this embodiment, first lower loop 50 and second lower loop 60 are teardrop shaped (i.e.: lachrymiform), although other arrangements are also contemplated.

In this embodiment, rear lower loop portion 54 and rear lower loop portion 64 include adjustable connectors 66. As discussed herein, adjustable connectors 66 are analogous to adjustable connectors 28 and can take a wide variety of forms provided that they provide the ability to adjust the size of first lower loop 50 and second lower loop 60.

Figure 5A:
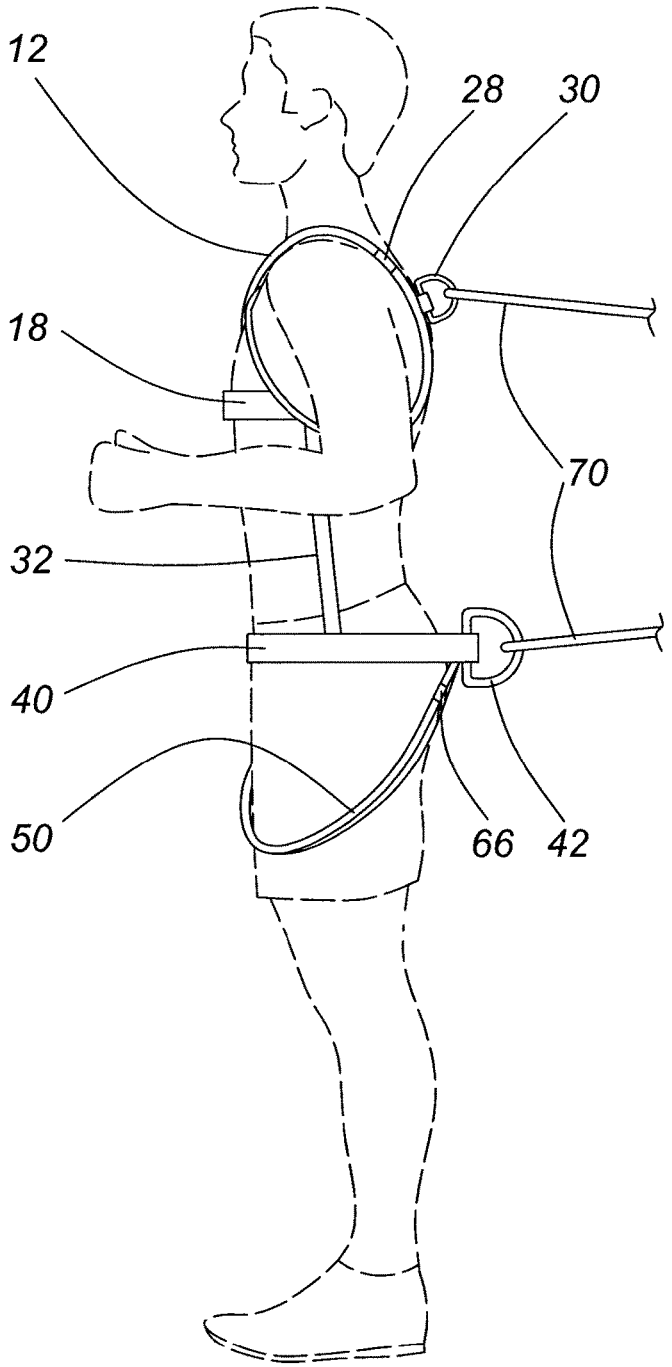
FIGS. 5A, 5B, 5C and 5D are illustrations of a user wearing a resistance training harness in accordance with at least one embodiment of the present invention.
Figure 5B:
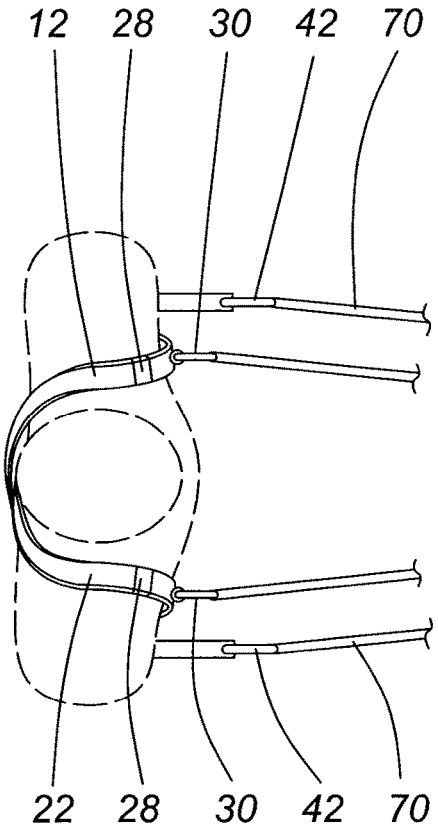
Figure 5C:
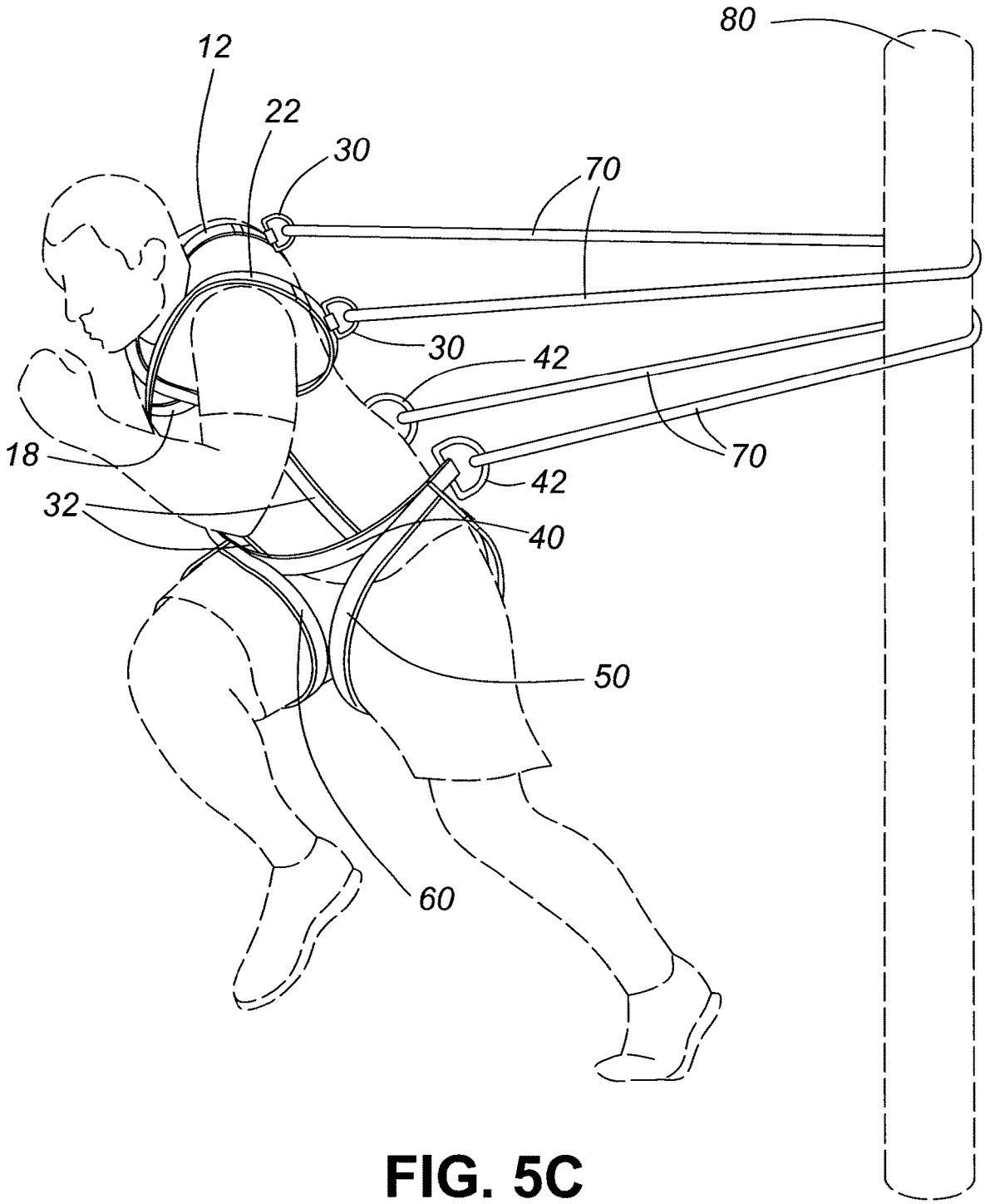

With reference to FIGS. 5*a*, 5*b* and 5*c*, in this way the user can don resistance training harness 10 by inserting the arms through upper loops 12, 22 of resistance training harness 10 and the legs through lower loops 50, 60 of resistance training harness 10 such that transverse belt component 40 extends across the user's hips (ideally, below the user's waist) and upper loops 12, 22 are adjoined across the user's chest. Upper loops 12, 22 and lower loops 50, 60 can be secured about the user's arms and legs using adjustable connectors 28, 66, in order to obtain a secure fit.

Next, one end of a first, elasticized resilient cord 70 can be attached to one of attachment means 30, the resilient cord 70 can be looped around a structure 80 such as a post, a wall or a doorway anchor, and the second end of the resilient cord 70 can be attached to the other of attachment means 30. Similarly, one end of a second, resilient cord 70 can be attached to one of attachment means 42, the resilient cord 70 can be looped around the same post, and the second end of the resilient cord 70 can be attached to the other of attachment means 42.

Figure 5D:
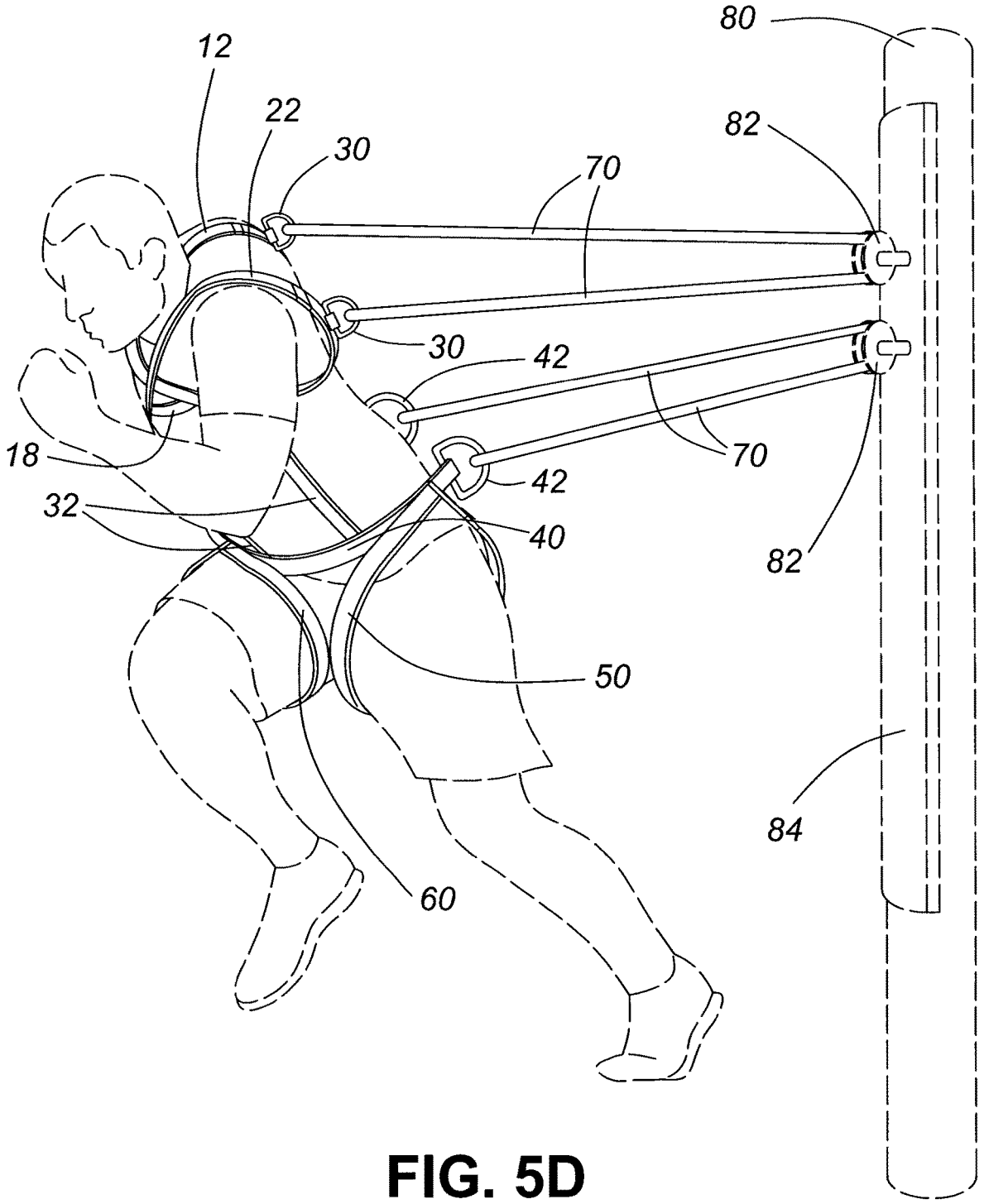

Turning to FIG. 5*d*, in this embodiment structure 80 has a number of additional features that increase the functionality of the present invention. More specifically, in this embodiment structure 80 includes at least one pulley 82 in turn receives each resilient cord 70, thereby permitting smooth movement of resilient cord 70 as the user moves relative to structure 80.

Moreover, it is contemplated that pulley 82 is in turn be mounted to a sliding track 84 which in turn permits pulley 82 to slide longitudinally along sliding track 84 as the user moves relative to structure 80. In this embodiment, it is contemplated that sliding track 84 is mounted in a generally vertical orientation however as will be understood by the skilled person it is contemplated that the sliding track can also be mounted horizontally, or in any other direction that is required by the particular end user application.

While the present invention has been described with reference to two particular embodiments it will be apparent to anyone skilled in the art that there are many permutations and combinations of combining the primary response variables to achieve particular benefits. All such permutations and combinations are considered to be within the sphere and scope of this invention as defined in the claims appended hereto.

What is claimed is:

1. A resistance training harness comprising:

a first upper loop having a front portion and a rear portion, the rear portion having an outer surface having attachment means;

a second upper loop having a front portion and a rear portion, the rear portion having an outer surface having attachment means, wherein the first upper loop and the second upper loop are comprised of a first elongate strap element and a second elongate strap element, the first elongate strap element having a first end and a second end, the second elongate strap element having a first end and a second end, the first end of the first elongate strap element adjoining the second end of the second elongate strap element by a first adjustable connector located at the rear portion of the first upper loop, the second end of the first elongate strap element adjoining the first end of the second elongate strap element by a second adjustable connector located at the rear portion of the second upper loop, the first elongate strap element overlapping the second elongate strap element, wherein the overlapping is configured to be located in front of a wearer of the resistance training harness, the first elongate strap element and the second elongate strap element arranged in a continuous lemniscate shape defining the first upper loop and the second upper loop such that the front portion of the first upper loop is configured to be adjacent to the front portion to the second upper loop and the rear portion of the first upper loop is configured to be laterally spaced apart from the rear portion of the second upper loop when worn by the wearer of the resistance training harness;

a transverse belt component having a first end and a second end, the transverse belt component adjoining at least one front connector between the first end and the second end of the transverse belt component, the first end of the transverse belt component and second end of the transverse belt component each having attachment means;

a first lower loop having a front portion and a rear portion;

a second lower loop having a front portion and a rear portion, the first lower loop and the second lower loop adjoining the transverse belt component; and at least one resilient cord, the at least one resilient cord having at least one connector adapted to engage with the attachment means of at least one of the first upper loop, the second upper loop, and the transverse belt component.

2. The resistance training harness of claim 1 wherein each of the first adjustable connector and the second adjustable connector vary and secure a perimeter length of the respective first upper loop and the second upper loop.

3. The resistance training harness of claim 2 wherein at least one of the first adjustable connector and the second adjustable connector is selected from the group consisting of: a hook and loop fastener, a ratchet strap, a snap-fit buckle, a clasp closure, a double D ring closure and a triple D ring closure.

4. The resistance training harness of claim 1 wherein the rear portions of each of the first lower loop and the second lower loop have an adjustable connector for varying and securing a perimeter length of the respective first lower loop and the second lower loop.

5. The resistance training harness of claim 4 wherein at least one of the adjustable connector of the first lower loop and the second lower loop is selected from the group consisting of: a hook and loop fastener, a ratchet strap, a snap-fit buckle, a clasp closure, a double D ring closure and a triple D ring closure.

6. The resistance training harness of claim 1 wherein the at least one front connector comprises a first end and a second end, the first end of the at least one front connector adjoins one of the front portion of the first upper loop and the front portion of the second upper loop.

7. The resistance training harness of claim 1 wherein the at least one front connector is further comprised of two strap elements adjoined by a hook and loop fastener.

8. The resistance training harness of claim 1 wherein the attachment means of the first upper loop, the second upper loop, and the transverse belt component are each an integrally and pivotably mounted D ring.

9. The resistance training harness of claim 1 further comprising at least one transverse front brace having a first end and a second end, the first end of the at least one transverse front brace adjoining the front portion of the first upper loop and the second end of the at least one transverse front brace adjoining the front portion of the second upper loop.

10. The resistance training harness of claim 1 wherein the rear portion of at least one of the first upper loop, the second upper loop, the first lower loop and the second lower loop is comprised of an elasticized material.

11. The resistance training harness of claim 1 further comprising a transverse rear brace having a first end and a second end, the first end of the transverse rear brace adjoining the rear portion of the first upper loop and the second end of the transverse rear brace adjoining the rear portion of the second upper loop.

* * * * *